US011319713B2

(12) United States Patent
O'Keefe et al.

(10) Patent No.: US 11,319,713 B2
(45) Date of Patent: May 3, 2022

(54) ELEVATING CAGE WITH PIVOTABLY ATTACHED PANELS HAVING RESPECTIVE PIVOTABLE LATCHES

(71) Applicant: Safe Rack LLC, Andrews, SC (US)

(72) Inventors: James Michael O'Keefe, Columbia, SC (US); James Pierce Daniel, III, Moncks Corner, SC (US)

(73) Assignee: Safe Rack LLC, Andrews, SC (US)

( * ) Notice: Subject to any disclaimer, the term of this patent is extended or adjusted under 35 U.S.C. 154(b) by 638 days.

(21) Appl. No.: 15/987,659

(22) Filed: May 23, 2018

(65) Prior Publication Data

US 2019/0360219 A1 Nov. 28, 2019

(51) Int. Cl.
*E04G 3/28* (2006.01)
*E04G 5/00* (2006.01)

(52) U.S. Cl.
CPC ..... *E04G 3/28* (2013.01); *E04G 5/001* (2013.01); *E04G 2003/286* (2013.01)

(58) Field of Classification Search
CPC ..... E05C 17/44; E05C 17/46; E05C 17/50; E05C 17/52; E05C 17/505; E05C 3/02; E05C 3/04; E05C 3/041; E05C 3/043; E05C 3/045; E05C 19/10; E05C 19/12; E05C 19/003; E04G 1/15; E04G 5/08;
(Continued)

(56) References Cited

U.S. PATENT DOCUMENTS 808,410 A * 12/1905 Tripp ..... E05C 19/003 292/259 R
1,495,373 A * 5/1924 Witten ..... E05B 83/02 292/108

(Continued)

FOREIGN PATENT DOCUMENTS

CN 2072560 U 3/1991
CN 101876211 A 3/2010

(Continued)

OTHER PUBLICATIONS

Extended European Search Report dated Oct. 29, 2019 in co-pending European patent application serial No. 19174626.2, all enclosed pages cited.

*Primary Examiner* — Daniel P Cahn
*Assistant Examiner* — Shiref M Mekhaeil
(74) *Attorney, Agent, or Firm* — Nelson Mullins Riley & Scarborough LLP

(57) ABSTRACT

An elevating cage system includes floor panels for a walk surface that can pivot upward to expose a portion of a container disposed below the platform. Each floor panel has a latch that pivots to engage a cage railing surrounding the platform and hold the floor panel in an open position. The latch is weighted about a pivot so that when the panel is pivoted to a completely open position, the latch pivots under its own weight to engage a stop so that the latch is disposed in an orientation to engage the handrail and hold the panel in the open position until an operator releases the latch. When the panel pivots to its closed position, the latch's weight balance about its pivot causes the latch to rotate until the latch engages the stop and is held in a stowed orientation in which the latch is entirely below a plane of an upper surface of the panel.

23 Claims, 5 Drawing Sheets

(58) Field of Classification Search
CPC ..... E04G 2003/286; E04G 3/28; E02D 29/14; E02D 29/09; E02D 29/1409; E02D 29/1427
See application file for complete search history.

(56) References Cited

U.S. PATENT DOCUMENTS 1,526,590 A * 2/1925 Briese ..... E06B 5/01 292/101
1,726,867 A * 9/1929 Strang ..... E05F 11/382 49/278
1,750,423 A * 3/1930 Oglesby ..... E05C 3/043 292/202
2,324,699 A 7/1943 Harza
2,340,864 A * 2/1944 Carpenter ..... E04B 1/6183 52/127.9
2,714,751 A * 8/1955 Stuart ..... F16B 12/20 52/582.2
2,738,211 A * 3/1956 Schlueter ..... E05B 65/0817 292/111
3,347,580 A * 10/1967 Whiting ..... E05B 65/0811 292/128
3,622,189 A * 11/1971 Rosehitz ..... E05B 65/0811 292/240
3,642,314 A * 2/1972 Smith ..... E05B 13/002 292/134
3,811,718 A * 5/1974 Bates ..... E05C 3/045 292/241
4,014,572 A * 3/1977 Binns ..... E05B 65/0811 292/108
4,144,784 A * 3/1979 Jones ..... B26D 7/22 83/425.3
4,155,584 A 5/1979 Pracchia
4,417,430 A * 11/1983 Loikitz ..... E04B 1/6183 292/111
4,451,072 A * 5/1984 Petty, Sr. ..... E05C 3/14 292/104
4,512,122 A * 4/1985 Berkowitz ..... E04B 1/6183 29/453
4,536,022 A * 8/1985 Giordano ..... E05B 65/0007 292/207
5,205,073 A * 4/1993 Lyons, Sr. ..... E02D 29/1418 49/379
5,845,786 A 10/1998 Brown
6,139,074 A * 10/2000 Barnett ..... E05B 13/002 292/108
6,808,080 B2 10/2004 Spiers et al.
6,874,198 B2 * 4/2005 Renaud ..... E05B 17/005 16/65
7,134,860 B2 11/2006 Pierik et al.
7,578,247 B2 8/2009 Horn
8,474,576 B2 * 7/2013 Renish ..... E04G 1/34 182/129
8,678,451 B2 * 3/2014 Martin ..... E05B 65/0007 292/210
9,021,743 B2 * 5/2015 Piermee ..... E02D 29/1418 49/387
9,303,441 B2 * 4/2016 Bravo ..... E05F 1/1058
9,347,679 B2 * 5/2016 Bruhnke ..... F24F 13/084
9,409,755 B2 8/2016 Melton et al.
10,577,838 B2 * 3/2020 Mitchell ..... E05B 77/38
2002/0134285 A1 * 9/2002 Bruschi ..... A47B 7/02 108/133
2004/0108742 A1 * 6/2004 Pringnitz ..... E05C 3/045 296/50
2004/0140676 A1 * 7/2004 Eklund ..... E05B 65/0021 292/97
2005/0023839 A1 * 2/2005 Franich ..... B65F 1/1452 292/113
2005/0126235 A1 * 6/2005 Melchiori ..... E05B 13/002 70/210
2007/0175703 A1 * 8/2007 Brasil ..... E04G 1/15 182/222
2008/0305938 A1 * 12/2008 Hayasaka ..... E05B 47/023 494/12
2009/0115204 A1 * 5/2009 Rycroft ..... E05C 3/043 292/341.17
2009/0223261 A1 * 9/2009 Steinbeck ..... E05B 17/0025 70/93
2010/0122559 A1 * 5/2010 Chudzicki ..... E05B 13/002 70/56
2010/0307060 A1 * 12/2010 Slimak ..... E05B 65/006 49/70
2011/0101710 A1 * 5/2011 Elbrecht ..... E05B 17/0033 292/202
2011/0219697 A1 * 9/2011 Phelps ..... E05C 3/045 49/449
2013/0164080 A1 * 6/2013 Miller ..... E02F 3/3627 403/327
2014/0251730 A1 * 9/2014 Bisset ..... E04G 1/154 182/150
2014/0300114 A1 * 10/2014 Atkinson, Jr. ..... E05C 17/44 292/259 R
2015/0034418 A1 * 2/2015 Melton ..... B66F 17/006 182/113
2015/0259957 A1 * 9/2015 Hernandez ..... B64D 29/06 292/97
2015/0330123 A1 * 11/2015 Liau ..... E05C 3/12 292/96
2016/0208519 A1 * 7/2016 Sljivic ..... E05C 3/042
2017/0328098 A1 * 11/2017 Ben-Zion ..... E05B 15/0046
2018/0202202 A1 * 7/2018 Celis Torres ..... E05C 17/085

FOREIGN PATENT DOCUMENTS

CN 205590252 U 9/2016
DE 2608333 A1 9/1977
FR 2729693 A1 7/1996
KR 2020140002826 U 5/2014

* cited by examiner

ELEVATING CAGE WITH PIVOTABLY ATTACHED PANELS HAVING RESPECTIVE PIVOTABLE LATCHES

FIELD OF THE INVENTION

Example embodiments generally relate to elevating cages, and, in particular, to elevating cages with pivotally attached floor panels which can be latched in a raised position.

BACKGROUND OF THE INVENTION

Elevating cages are commonly used to provide full surrounding barrier fall protection for personnel accessing top hatches of shipping containers such as, for example, tank trailers and tanker rail cars. An elevating cage typically includes a set of columns and a cage structure that is attached to the columns with roller carriages so as to move vertically with respect to the columns. Once the container is positioned (i.e., "spotted"), the cage structure is lowered down to a height at which adequate fall protection is provided. To provide access to a hatch or other work area on top of the vehicle, the user will deploy a gangway or other means of access through an opening in the cage structure. The cage structure can include walk surfaces. For example, the elevating cage system may have one or more pivotable floor panels ("flip-up panels") that in the down position provide a walk surface but may be raised to provide an access portal to the vehicle container therebelow.

In the configuration shown in U.S. Pat. No. 9,409,755 to Melton, a respective latch attached to the cage engages a latch pin on each floor panel in order to retain the floor panel in a raised position. However, such latches are disadvantageous for various reasons including that they protrude into the cage, thereby causing catch points and trip hazards that interfere with workers in the cage.

SUMMARY OF THE INVENTION

The present invention recognizes and addresses the foregoing considerations, and others, of prior art constructions and methods.

One aspect of the present invention provides a platform assembly comprising a support structure. A platform structure is coupled with the support structure and defines a platform floor. The platform structure has at least one pivotally attached panel (such as a plurality of adjacent pivotally attached panels) movable from a first position forming at least a portion of the platform floor and a second position that is rotationally offset from the first position. A panel latch configured to engage an attachment structure in order to retain the panel in the second position is also provided. The panel latch is pivotable about an axis with respect to the at least one panel so that it moves between a stowed orientation substantially below a surface of the platform floor and a latching orientation to engage the attachment structure.

Preferably, the platform structure further comprises a cage located about a perimeter of the platform floor. In such embodiments, the cage may provide the attachment structure for the latch. For example, the cage may include an upper rail which also functions as the attachment structure. Often, the platform structure may be movable vertically with respect to the support structure.

In some exemplary embodiments, the latch pivots between the stowed orientation and the latching orientation due to a weight imbalance of the latch about the axis that causes a first moment in a first rotational direction about the axis when the at least one panel is in the first position and a second moment in a second rotational direction opposite the first rotational direction about the axis when the at least one panel is in the second position. For example, the at least one panel may be horizontal in the first position. In the second position, the at least one panel may be rotationally offset from the first position by at least 90 degrees. In the stowed orientation, the latch may be held entirely below the plane defined by the surface of the platform floor due to its weight imbalance.

Embodiments are contemplated in which the at least one panel has a stop positioned to engage the latch when the latch is in the stowed orientation to prevent rotation of the latch beyond the stowed orientation. The stop may be further positioned to engage the latch when the latch is in the latching orientation to prevent rotation of the latch beyond the latching orientation. The latch may have a head portion for engaging the attachment structure on one side of the axis and a tail portion on another side of the axis providing a release handle, the head portion having greater rotational moment than the tail portion.

According to another aspect, the present invention provides a platform assembly comprising a support structure. A platform structure is coupled with the support structure and defines a platform floor with a cage located about a perimeter of the platform floor. The platform structure has at least one pivotally attached panel movable between a first position forming at least a portion of the platform floor and a second position that is rotationally offset from the first position. An attachment structure (i.e., keeper) carried by the cage is engaged by a panel latch in order to retain the panel in the second position. The panel latch is pivotable with respect to the at least one panel so that it moves between a stowed orientation and a latching orientation to engage the attachment structure due to a weight imbalance of the latch that causes a first moment in a first rotational direction when the at least one panel is in the first position and a second moment in a second rotational direction opposite the first rotational direction when the at least one panel is in the second position.

A still further aspect of the present invention provides a platform assembly comprising a platform structure. A rectangular panel having a proximal end and a distal end is also provided. The proximal end of the panel is pivotally attached to the platform structure so that the panel can move between a lowered position and a raised position rotationally offset from the lowered position by at least 90 degrees. A latch is pivotally connected to the panel, the latch being located adjacent to a side of the panel and spaced apart from the proximal end of the panel. An attachment structure is carried by the platform structure at a location to be engaged by the latch when the panel is in the raised position. The latch has a weight imbalance that tends to maintain the latch in a latching orientation engaging the attachment structure when the panel is in the raised position and rotates the latch into a stowed orientation when the panel is moved into the lowered position.

Further aspects of the present invention may be discerned from the description herein. The accompanying drawings, which are incorporated in and constitute a part of this specification, illustrate one or more embodiments of the present invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
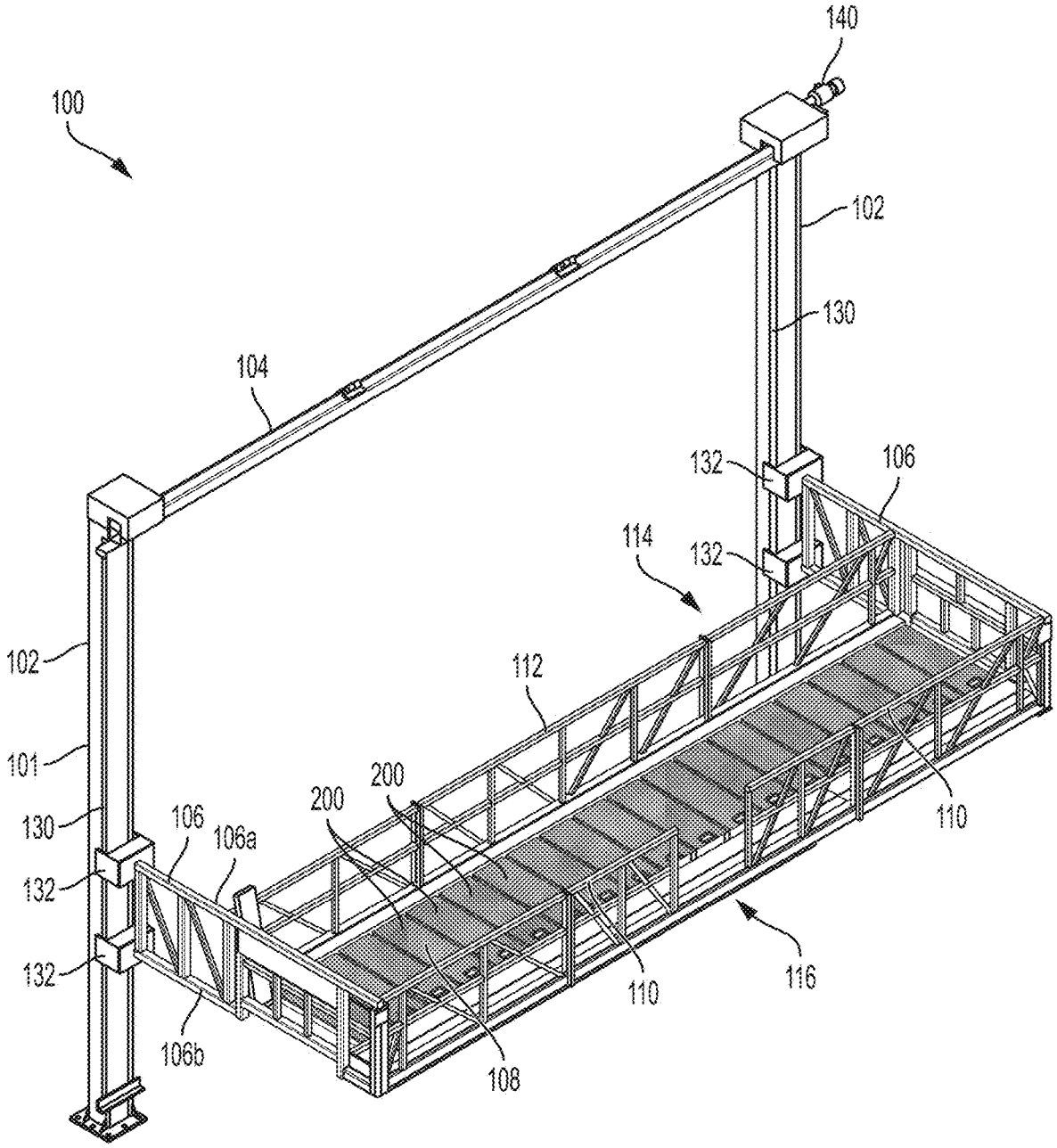
FIG. 1 is a perspective view of an elevating cage with pivotably attached floor panels in accordance with an embodiment of the present invention.

Repeat use of reference characters in the present specification and drawings is intended to represent same or analogous features or elements of the invention according to the disclosure.

DESCRIPTION OF THE PREFERRED EMBODIMENTS

Some example embodiments will now be described more fully hereinafter with reference to the accompanying drawings, in which some, but not all, example embodiments are shown. Indeed, the examples described and pictured herein should not be construed as being limiting as to the scope, applicability, or configuration of the present disclosure. Like reference numerals refer to like elements throughout. As used herein, "operable coupling" should be understood to relate to direct or indirect connection that, in either case, enables functional interconnection of components that are operably coupled to each other.

As used herein, terms referring to a direction or a position relative to the orientation of an elevating cage, such as but not limited to "vertical," "horizontal," "above," or "below," refer to directions and relative positions with respect to the elevating cage's orientation in its normal intended operation, as indicated in FIG. 1.

Further, the term "or" as used in this disclosure and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

FIG. 1 illustrates an example embodiment of an elevating cage apparatus 100 including a support structure 101 (e.g., a frame). The support structure includes a pair of hollow vertical columns 102 spaced apart from one another as shown. The bottom ends of columns 102 are fixed with respect to the earth and a cross support member 104 extends between the upper ends of columns 102. Columns 102 are attached to a foundation using anchor bolts, which are either precast into the foundation or embedded into existing concrete in accordance with generally accepted engineering practices. A cantilevered end panel 106 extends horizontally forward from each column 102 to support a platform 108. In this case, end panels 106 each include a top member 106*a*, a bottom member 106*b*, and a plurality of structural support members extending therebetween. A pair of outboard rails 110 extend between, and attach to, respective distal ends of end panels 106 at a far (with respect to columns 102), front edge of the platform. An inboard rail 112 extends horizontally between end panels 106 at a near edge of platform 108 to thereby provide a generally rectangular cage structure 114 defined by cantilevered end panels 106 on its sides, outboard rails 110 on a front edge, inboard rail 112 on a rear edge, and the platform at a bottom. Rails 110 and 112 each include one or more cross-members that define portions of a cage about a perimeter of the platform. Between outboard rails 110 is an opening 116 that provides a worker access to the platform via gangway or other means of access. (Various combinations of end panels 106, platform 108, outboard rails 110, and/or inboard rail 112 may also be collectively referred to as a "platform structure.")

The end panels 106 are movable vertically along columns 102. In the illustrated embodiment, tracks 130 extend along the length of the sides of the respective columns 102. End panels 106 roll along tracks 130 via carriage roller assemblies 132. In an embodiment, carriage roller assemblies 132 include two sets of opposing wheels on each side of tracks 130 (i.e., front and rear sides of the tracks with respect to the front and rear of the elevating cage). Each end panel 106 travels along respective tracks 130 via two carriage roller assemblies, one at top and one at a bottom of each end panel 106. A motor 140, which may be, for example, electric or pneumatic, operably couples through a gearbox with carriage 114 to raise and lower the carriage. For example, in an embodiment, motor 140 couples with a gearbox that turns a shaft which has attached sprockets. Each sprocket drives a roller chain having an end attached to carriage 114 so that when the sprocket turns in a first direction, the sprocket lifts the carriage while the other end of the roller chain is attached to a counterweight that is located within support column 102.

Platform 108 comprises a plurality of rectangular floor panels 200, each of which is elongated in a direction transverse to the elongate direction of the platform, that are adjacent to one another. When in the lowered position shown, the upper surfaces of the panels 200 collectively form the platform floor on which the worker can stand or walk. Notably, however, each of the floor panels 200 is pivotally attached at their respective proximal ends (i.e., the ends nearer rail 112) so that they may be individually raised. In this way, the worked can access a container hatch or the like under the cage structure.

Figure 4:
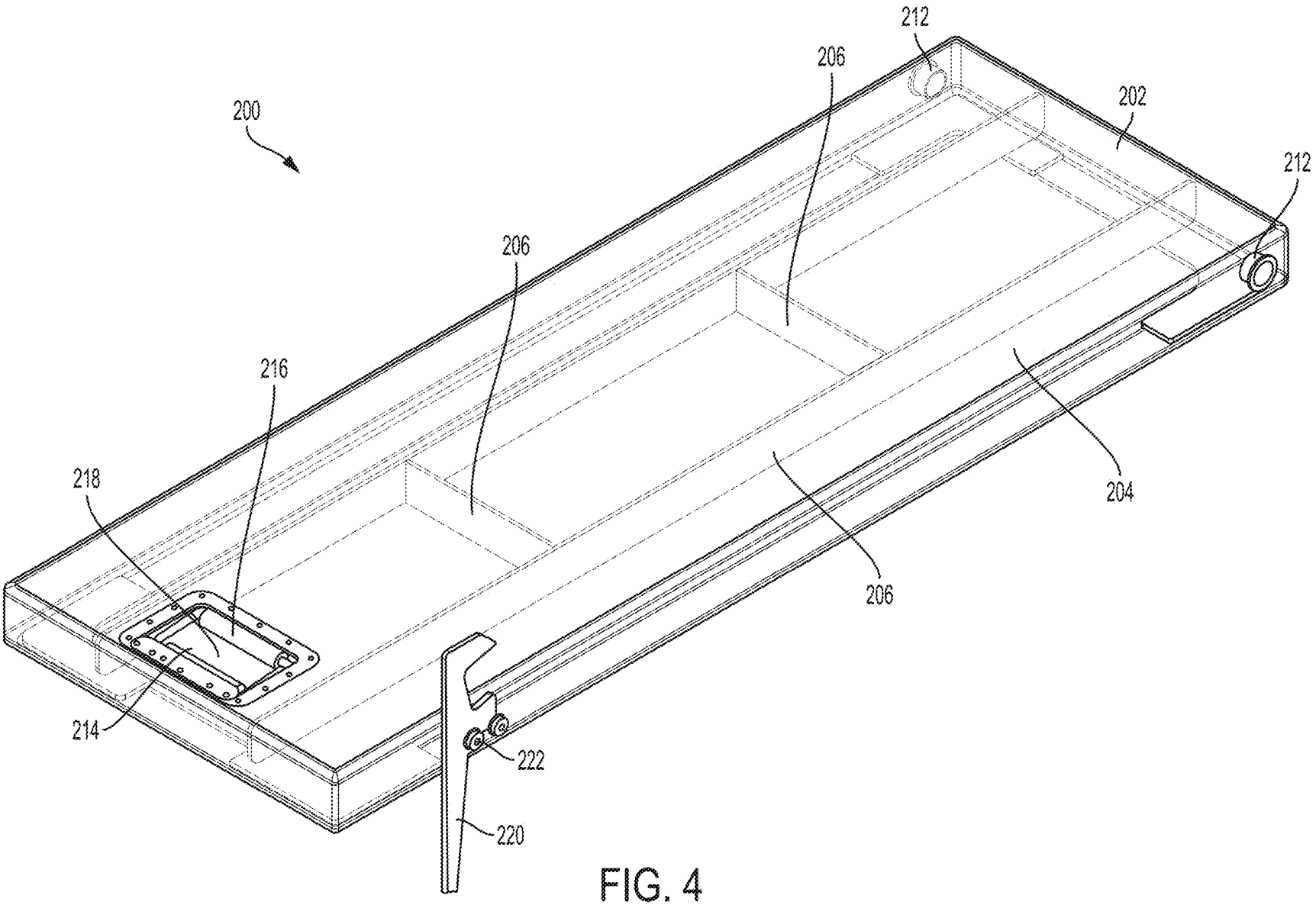
FIG. 4 is a perspective view of a floor panel of the elevating cage as in FIG. 1 with certain internal components in phantom and further showing a latch for holding the panel in the raised position (with the latch oriented vertically merely for purposes of illustration so that it can be more easily seen)

Referring to FIG. 4, each floor panel 200 in this case includes a formed aluminum sheet metal frame 202, a generally planar tread 204 (e.g., comprised of diamond plate 5052 aluminum), and a reinforcement ribs 206 (in this case including longitudinal and transverse ribs). The reinforcement ribs 206 may preferably include flanged tabs that provide surfaces for spot welding. Frame 202, tread 204, and ribs 206 are all preferably attached via weldment. Embodiments are contemplated in which frame 202 and tread 204 are integrally formed from a single piece of flat material that has been cut and folded to shape.

Figure 2:
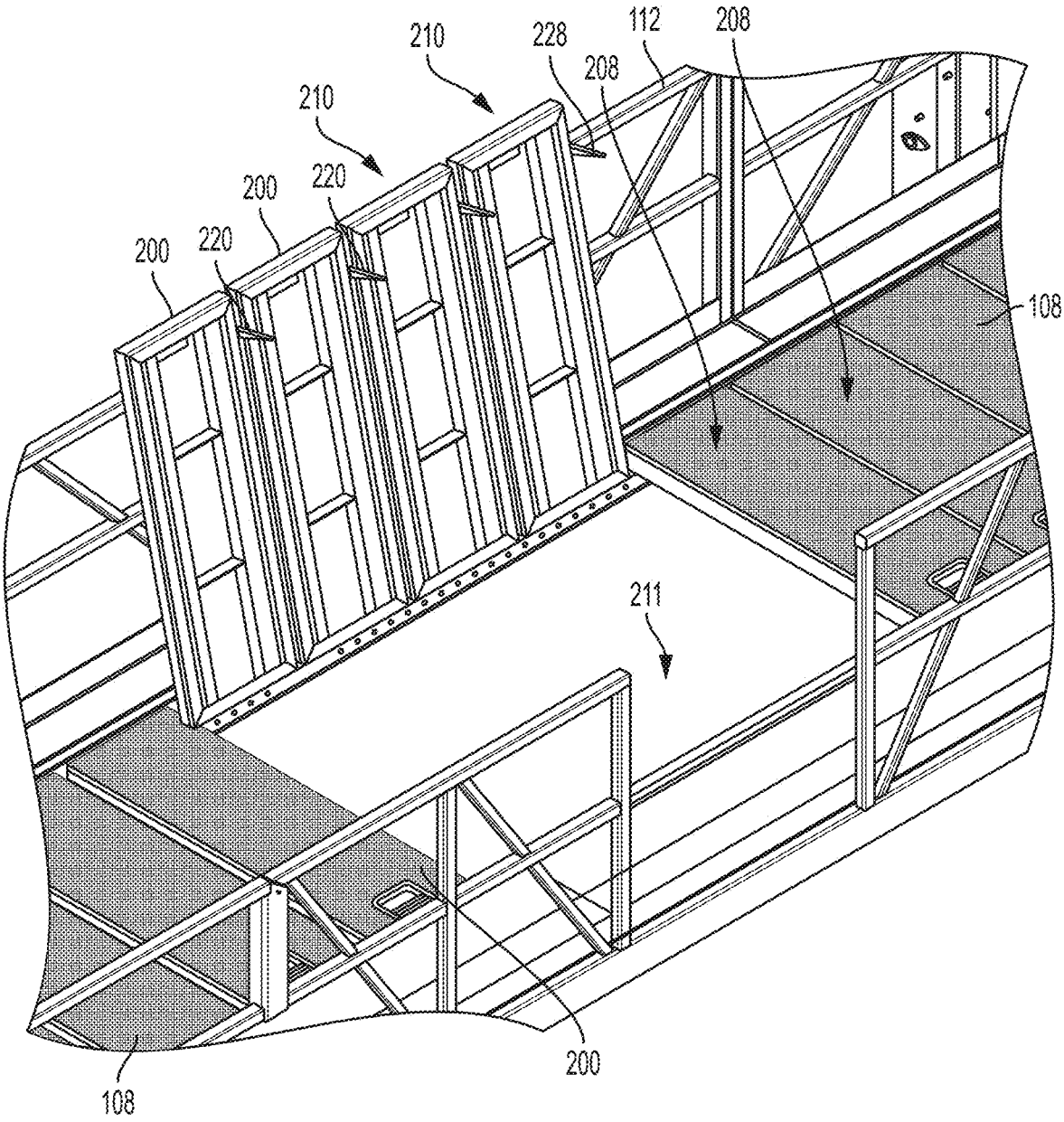
FIG. 2 is a partial perspective view of the elevating cage as in FIG. 1 with some of the pivotably attached panels in a raised position.
Figure 3:
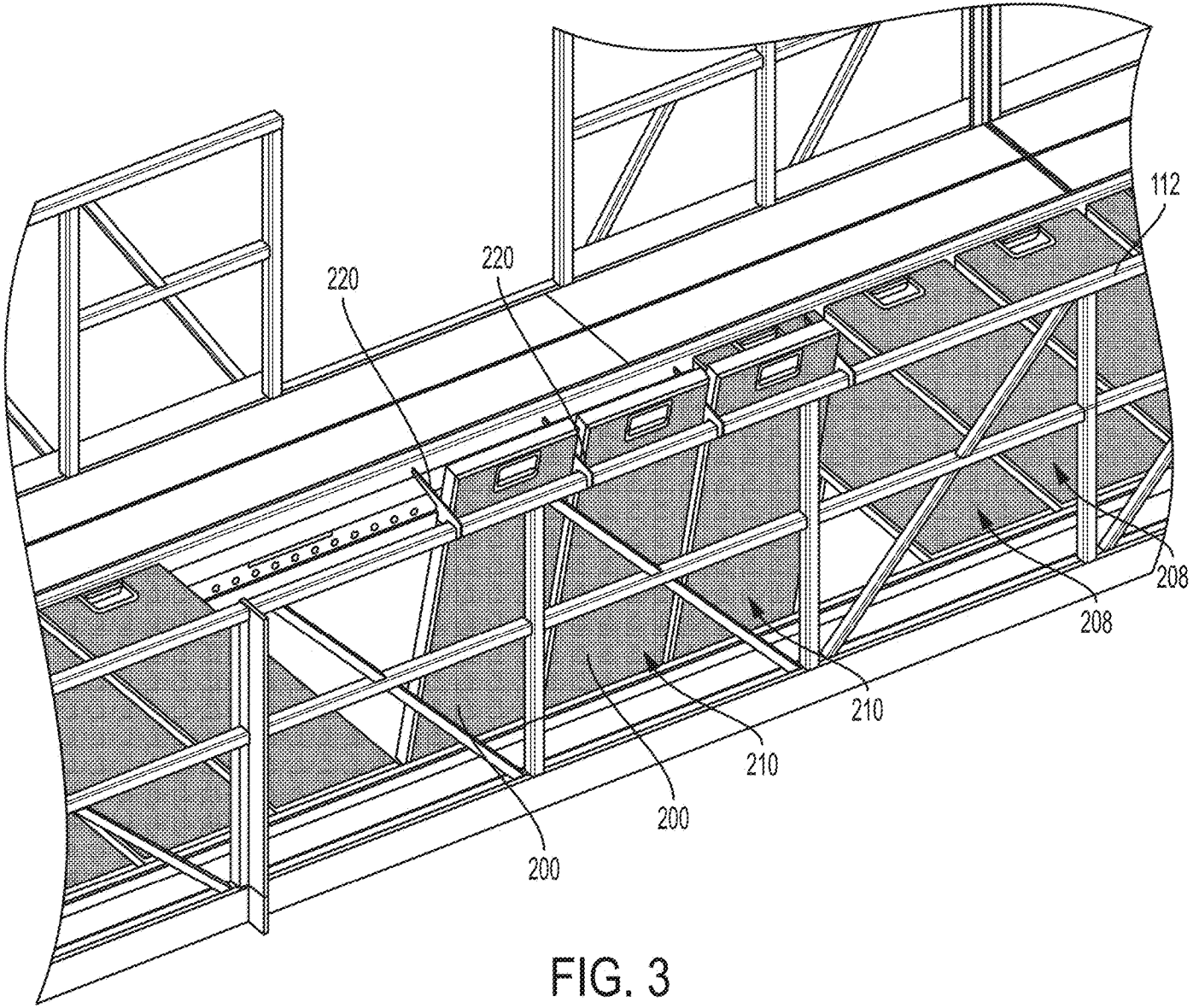
FIG. 3 is a rear partial perspective view of the elevating cage as in FIG. 2.

Referring also to FIGS. 2 and 3, floor panels 200 are pivotally connected as noted above to cage structure 114 (FIG. 1) at their proximal ends. In this regard, the proximal ends may be equipped with suitable hinges so that the panels may each be moved from a lowered position 208, in which tread 204 is level (i.e., parallel to a horizontal plane), to a raised position 210 that, in the illustrated embodiment, is rotationally offset from the first position by at least ninety degrees, thereby providing an access portal 211 to a container disposed therebelow. For example, floor panels 200 may pivot about oiled embedded bushings 212 (FIG. 4) that are pressed into holes defined in frame 202. A cutout in tread 204 defined near the distal end of panel 200 receives a recessed handle assembly 214. Handle assembly 214, which may for example be attached to tread 204 via rivets, includes a handle 216 and a recessed cup 218 that receives handle 216 flush with or below the plane of the tread's upper surface. The handle 216 is preferably spring-loaded (e.g., with a torsion spring) that urges the handle into cup 218.

Figure 5:
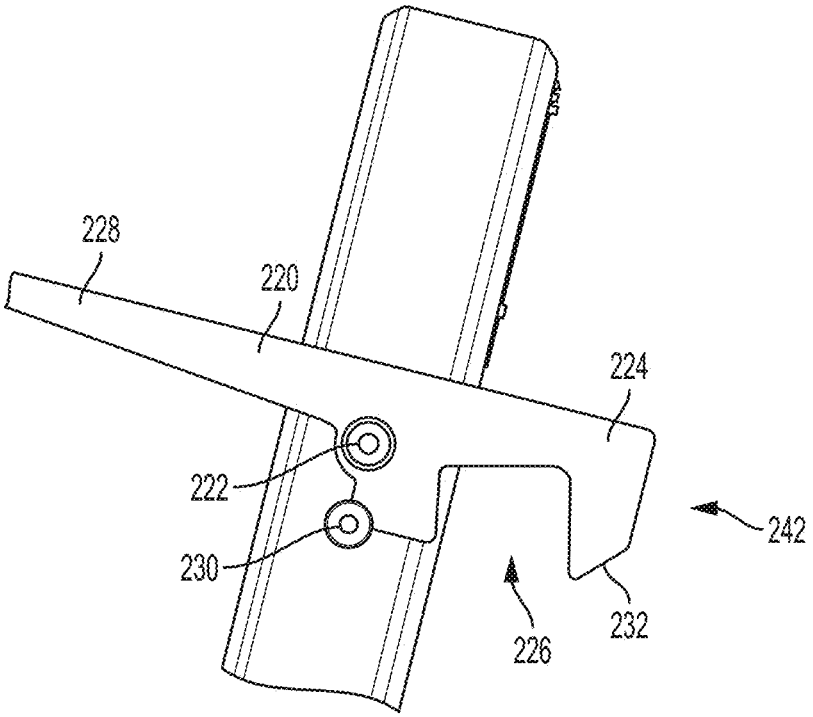
FIG. 5 is a partial side view of the floor panel as in FIG. 4 in a raised position such that the latch is in a working (latching) orientation.
Figure 6:
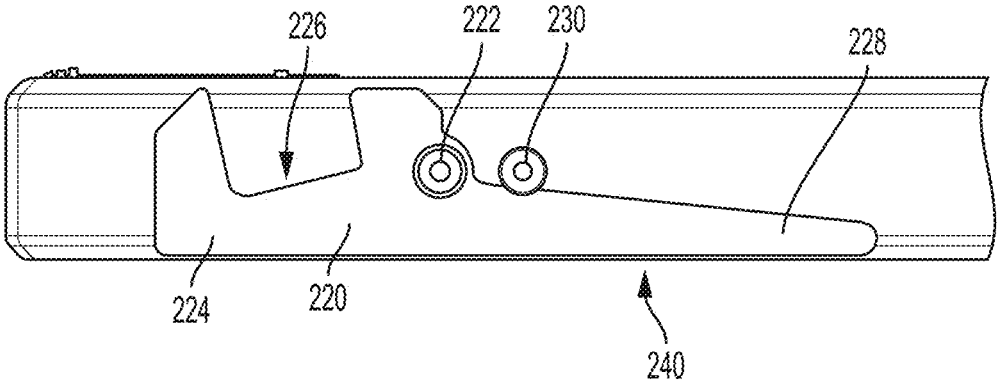
FIG. 6 is a partial side view of the floor panel as in FIG. 4 in a lowered position such that the latch is in a stowed orientation.

Referring also to FIGS. 5 and 6, each floor panel 200 includes a latch 220. As shown, latch 220 is pivotally connected to a side of panel 200 via a pin 222 at a location near the panel's distal end. On a first side of pin 222, latch 220 has a head portion 224 that has a generally rectangular catch cutout 226. Extending from pin 222 opposite head portion 224, latch 220 has a tail portion 228 with an elongated, tapered profile to provide a handle. A stop pin 230 extends sufficiently from frame 202 to engage latch 220 and act as a stop for latch 220 as further described herein. Latch 220 is balanced about pin 222 so that it will experience a moment that can be used to move latch 220 between stowed and working (latching) orientations.

In particular, according to the orientation in FIG. 6, the mass of the portion of the latch to the left of pin 222 (i.e., head portion 224) multiplied by the distance between its center of mass and pin 222 is greater than the mass of the portion of the latch to the right of pin 222 (i.e., tail portion 228) multiplied by the distance between its center of mass and pin 222. Thus, when panel 200 is in lowered position 208 (FIG. 6), a moment due to the weight imbalance causes latch 220 to pivot so that tail portion 228 rests against stop pin 230, thereby holding latch 220 in a stowed orientation 240. In stowed orientation 240, an entirety of latch 220 is disposed below a plane defined by the upper surface of tread 204 when the panel is in lowered position 208 and as such is not a trip hazard for the operator who may be walking around on the platform 108.

As floor panel 200 is lifted from lowered position 208 up to raised position 210, the floor panel reaches an intermediate position at which the moment of latch 220 about pin 222 due to its weight imbalance shifts from counterclockwise to clockwise (according to the orientation as shown in FIGS. 5 and 6). Beyond this intermediate position in the direction of raised position 210, the moment of latch 220 about pin 222 causes latch 220 to pivot to a working orientation 242, in which latch 220 is configured to engage rail 112 so that the rail retains the panel in the raised position. (In this case, rail 112 is actually formed of a plurality of parallel rail elements and latch 220 engages the topmost rail element.)

In working orientation 242, head portion 224 rests against stop pin 230, and rectangular cutout 226 is oriented so that when panel 200 rests against rail 112, latch 220 receives rail 112 within cutout 226 and holds floor panel 200 in the raised position against the rail. Such engagement of latch 220 with rail 112 is shown in FIG. 3. Preferably, the leading edge of head portion 224 may be at least partially tapered, as indicated at 232, which allows it to "ride" over rail 112 as panel 200 is fully raised. Once cutout 226 is aligned with rail 112, latch 220 will further rotate to the latching orientation of FIG. 5.

In this way, rail 112 acts as an attachment structure (i.e., a keeper) for latch 220. In order to release latch 220 from rail 112, an operator must depress the tail portion 228, thereby causing the latch to pivot about pin 222 and causing head portion 224 to lift away from, and disengage from, the rail 112. As can be seen in FIG. 2, the tail portion 228 extends into the interior area of the cage for access by the worker.

It can thus be seen that the present invention provides an elevating cage having flip-up panels with a novel latching arrangement. While one or more preferred embodiments of the invention are described above, it should be appreciated by those skilled in the art that various modifications and variations can be made in the present invention without departing from the scope and spirit thereof. For example, while the illustrated embodiment includes a single stop pin, in a further embodiment, a first stop pin holds the latch in the first orientation, and a second pin holds the latch in the second orientation. Accordingly, it should be understood that the elements of one embodiment may be combined with another embodiment to create a still further embodiment. It is intended that the present invention cover such modifications and variations as come within the scope and spirit of the present disclosure, the appended claims, and their equivalents.

The following is claimed:

1. A platform assembly comprising:

a support structure;

a platform structure coupled with the support structure and defining a platform floor;

the platform structure having at least one pivotally attached panel movable from a first position forming at least a portion of the platform floor and a second position that is rotationally offset from the first position;

a panel latch attached to the panel and movable with the panel between the first position and the second position, said panel latch being configured to engage an attachment structure in order to retain the panel in the second position; and wherein the panel latch is pivotable about an axis with respect to the at least one panel so that it moves between a stowed orientation substantially below a walk surface of the platform floor and a latching orientation to engage the attachment structure.

2. The platform assembly as in claim 1, wherein the platform structure further comprises a cage located about a perimeter of the platform floor.

3. The platform assembly as in claim 2, wherein the cage carries the attachment structure for the latch.

4. The platform assembly as in claim 3, wherein the cage includes an upper rail which functions as the attachment structure for the latch.

5. The platform assembly as in claim 1, wherein the platform structure is movable vertically with respect to the support structure.

6. The platform assembly as in claim 1, wherein said at least one pivotally attached panel comprises a plurality of adjacent pivotally attached panels, each having a respective one of said panel latch.

7. The platform assembly as in claim 1, wherein the latch pivots between the stowed orientation and the latching orientation due to a weight imbalance of the latch about the axis that causes a first moment in a first rotational direction about the axis when the at least one panel is in the first position and a second moment in a second rotational direction opposite the first rotational direction about the axis when the at least one panel is in the second position.

8. The platform assembly as in claim 7, wherein when the at least one panel is in the first position, the at least one panel is horizontal.

9. The platform assembly as in claim 8, wherein when the at least one panel is in the second position, the at least one panel is rotationally offset from the first position by at least 90 degrees.

10. The platform assembly as in claim 9, wherein in the stowed orientation, the latch is entirely below a plane defined by the walk surface of the platform floor.

11. The platform assembly as in claim 1, wherein the at least one panel has a stop positioned to engage the latch when the latch is in the stowed orientation to prevent rotation of the latch beyond the stowed orientation.

12. A platform assembly comprising:

a support structure;

a platform structure coupled with the support structure and defining a platform floor;

the platform structure having at least one pivotally attached panel movable from a first position forming at least a portion of the platform floor and a second position that is rotationally offset from the first position;

a panel latch configured to engage an attachment structure in order to retain the panel in the second position;

wherein the panel latch is pivotable about an axis with respect to the at least one panel so that it moves between a stowed orientation substantially below a walk surface of the platform floor and a latching orientation to engage the attachment structure;

wherein the at least one panel has a stop positioned to engage the latch when the latch is in the stowed orientation to prevent rotation of the latch beyond the stowed orientation; and wherein the stop is positioned to engage the latch when the latch is in the latching orientation to prevent rotation of the latch beyond the latching orientation.

13. The platform assembly as in claim 12, wherein the latch has a head portion for engaging the attachment structure on one side of the axis and a tail portion on an other side of the axis providing a release handle, the head portion having greater rotational moment than the tail portion.

14. A platform assembly comprising:

a support structure;

a platform structure coupled with the support structure and defining a platform floor, said platform structure including a cage located about a perimeter of the platform floor;

the platform structure having at least one pivotally attached panel movable between a first position forming at least a portion of the platform floor and a second position that is rotationally offset from the first position;

an attachment structure carried by the cage;

a panel latch attached to the panel and movable with the panel between the first position and the second position, said panel latch configured to engage the attachment structure in order to retain the panel in the second position; and wherein the panel latch is pivotable with respect to the at least one panel so that it moves between a stowed orientation and a latching orientation to engage the attachment structure due to a weight imbalance of the latch that causes a first moment in a first rotational direction when the at least one panel is in the first position and a second moment in a second rotational direction opposite the first rotational direction when the at least one panel is in the second position.

15. The platform assembly as in claim 14, wherein the cage includes an upper rail which functions as the attachment structure.

16. The platform assembly as in claim 14, wherein the platform structure is movable vertically with respect to the support structure.

17. The platform assembly as in claim 14, wherein said at least one pivotally attached panel comprises a plurality of adjacent pivotally attached panels, each having a respective one of said panel latch.

18. The platform assembly as in claim 14, wherein when the at least one panel is in the second position, the at least one panel is rotationally offset from the first position by at least 90 degrees.

19. The platform assembly as in claim 18, wherein in the stowed orientation, the latch is entirely below a plane defined by a walk surface of the platform floor.

20. A platform assembly comprising:

a platform structure;

a rectangular panel having a proximal end and a distal end, said proximal end of said panel being pivotally attached to said platform structure so that said panel can move between a lowered position and a raised position rotationally offset from the lowered position by at least 90 degrees;

a latch pivotally connected to said panel and movable with said panel between the lowered position and the raised position, said latch being located adjacent to a side of said panel and spaced apart from said proximal end of said panel;

an attachment structure carried by said platform structure at a location to be engaged by said latch when said panel is in the raised position; and wherein the latch has a weight imbalance that tends to maintain the latch in a latching orientation engaging said attachment structure when said panel is in the raised position and rotates the latch into a stowed orientation when said panel is moved into said lowered position.

21. The platform assembly as in claim 20, wherein the latch has a head portion for engaging the attachment structure on one side of a rotational axis thereof and a tail portion on an other side of the rotational axis providing a release handle, the head portion having greater mass than the tail portion.

22. The platform assembly as in claim 21, wherein the at least one panel has a stop positioned to engage the latch when the latch is in the stowed orientation to prevent rotation of the latch beyond the stowed orientation.

23. The platform assembly as in claim 22, wherein the stop is positioned to engage the latch when the latch is in the latching orientation to prevent rotation of the latch beyond the latching orientation.

* * * * *